US008107832B2

(12) United States Patent
Honda

(10) Patent No.: US 8,107,832 B2
(45) Date of Patent: Jan. 31, 2012

(54) IMAGE FORMING APPARATUS

(75) Inventor: Takahiro Honda, Osaka (JP)

(73) Assignee: Kyocera Mita Corporation (JP)

( * ) Notice: Subject to any disclaimer, the term of this patent is extended or adjusted under 35 U.S.C. 154(b) by 422 days.

(21) Appl. No.: 12/484,247

(22) Filed: Jun. 15, 2009

(65) Prior Publication Data

US 2009/0317101 A1 Dec. 24, 2009

(30) Foreign Application Priority Data

Jun. 19, 2008 (JP) ..... 2008-160081

(51) Int. Cl.
*G03G 15/00* (2006.01)

(52) U.S. Cl. ..... 399/38; 399/66; 399/299; 399/306

(58) Field of Classification Search ..... 399/38, 399/66, 299, 306
See application file for complete search history.

(56) References Cited

U.S. PATENT DOCUMENTS 6,061,542 A * 5/2000 Minami et al. ..... 399/299
2007/0116497 A1* 5/2007 Yamazaki ..... 399/299

FOREIGN PATENT DOCUMENTS

JP H10-293437 A 11/1998

* cited by examiner

*Primary Examiner* — Ryan Walsh
(74) *Attorney, Agent, or Firm* — Ostrolenk Faber LLP

(57) ABSTRACT

An image forming apparatus includes a belt, an image forming section, a displacement operation section and a displacement control section. The image forming section includes a color image forming unit and a monochrome image forming unit. The displacement operation section conducts a press-contact operation and a release operation. The press-contact operation brings into contact the image carrier and the belt. The release operation separates the image carrier from the belt. The displacement control section controls the displacement operation section to perform the press-contact operation when the cumulative number of color images is greater than the cumulative number of monochrome images after the image forming section forms a series of images. The displacement control section controls the displacement operation section to perform the release operation when the cumulative number of color images is less than the cumulative number of monochrome images after the image forming section forms a series of images.

16 Claims, 9 Drawing Sheets

IMAGE FORMING APPARATUS

CROSS-REFERENCE TO RELATED APPLICATIONS

This application claims priority under 35 U.S.C. §119 to Japanese Patent Application No. 2008-160081 filed on Jun. 19, 2008. The entire disclosure of Japanese Patent Application No. 2008-160081 is hereby incorporated herein by reference.

BACKGROUND OF THE INVENTION

1. Field of the Invention

The present invention relates to an image forming apparatus.

2. Background Information

The tandem image forming apparatus has been conventionally produced as a full-color image forming apparatus. The tandem image forming apparatus generally includes a transport belt and units for forming black, magenta, cyan and yellow images (hereinafter simply referred to as "image forming units"). The image forming units are disposed along a direction that the transport belt transports a sheet of printing paper.

The tandem image forming apparatus is configured to form a color image by sequentially transferring toner images, formed on photosensitive bodies of the image forming units, onto a sheet of paper transported by the transport belt.

In the image forming apparatus of this type, the photosensitive bodies of the image forming units and the transport belt always make contact with each other.

In forming a monochrome image, only the black image forming unit forms a toner image whereas the magenta, cyan and yellow image forming units do not form any toner images. Nevertheless, all the photosensitive bodies of the image forming units and the transfer belt make contact with each other.

When a sheet of printing paper is transported while the transport belt and the photosensitive bodies make contact with each other, the photosensitive bodies may be damaged.

In response to the drawback, a mechanism has been proposed for separating color photosensitive bodies (i.e., photosensitive bodies of magenta, cyan and yellow image forming units) from a transport belt in printing a monochrome image and simultaneously making only a monochrome photosensitive body (i.e., a photosensitive body of a black image forming unit) press-contact to the transport belt.

As an example of the mechanism, the following image forming apparatus has been produced. In forming a full-color image, the image forming apparatus is configured to make a transport belt press-contact to photosensitive drums by transfer rollers used for transferring images of black, magenta, cyan and yellow images. In forming a monochrome image, on the other hand, the image forming apparatus is configured to release the press-contact condition between the transport belt and the photosensitive drums by displacing the transfer rollers downward. With the configuration, the image forming apparatus is capable of preventing the life cycle of the photosensitive drums from being reduced.

However, the conventional image forming apparatus has had a drawback that it takes long time to actually provide a user with printed material after the image forming apparatus receives a user's instruction of a print job. This is because the conventional image forming apparatus is configured to displace the transfer rollers when a print job (i.e., first job) is completed and subsequently a type (i.e., monochrome printing or color printing) of the next print job (i.e., second job) is determined. In other words, the conventional image forming apparatus is not capable of starting the second job until the displacement is completed.

SUMMARY OF THE INVENTION

An aspect of the present invention is to provide an image forming apparatus and to prolong the life cycle of photosensitive bodies exclusively used for color printing and for promptly starting the print process.

An image forming apparatus of the present invention includes a loop belt, an image forming section, a displacement operation section, a cumulative value obtainment section, a comparison section, and a displacement control section. The loop belt is configured to circulate. The image forming section includes a color image forming unit and a monochrome image forming unit. The color image forming unit has a first image carrier and a developing section for forming a color image on the surface of the first image carrier. The monochrome image forming unit has a second image carrier and a developing section for forming a monochrome image on the surface of the second image carrier. The displacement operation section conducts a press-contact operation and a release operation. The displacement operation section performs the press-contact operation for bringing into contact the first image carrier and the belt. On the other hand, the displacement operation section performs the release operation for separating the first image carrier from the belt. The cumulative value obtainment section obtains the cumulative number of color images and the cumulative number of monochrome images. The comparison section compares the cumulative number of color images and the cumulative number of monochrome images. The displacement control section controls the displacement operation section to perform the press-contact operation and the release operation. The displacement control section controls the displacement operation section in order to perform the pres-control operation when the cumulative number of color images is greater than the cumulative number of monochrome images after the image forming section forms a series of images. On the other hand, the displacement control section controls the displacement operation section in order to perform the release operation when the cumulative number of color images is less than the cumulative number of monochrome images after the image forming section forms a series of images.

These features, aspects and advantages of the present invention will become apparent to those skilled in the art from the following detailed description, which, taken in conjunction with the annexed drawings, disclose example embodiments of the present invention.

BRIEF DESCRIPTION OF THE DRAWINGS

Referring now to the attached drawings which form a part of this original disclosure.

DETAILED DESCRIPTION OF AN EXAMPLE EMBODIMENT

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

1-1. Summary of Image Forming Apparatus A

Figure 1:
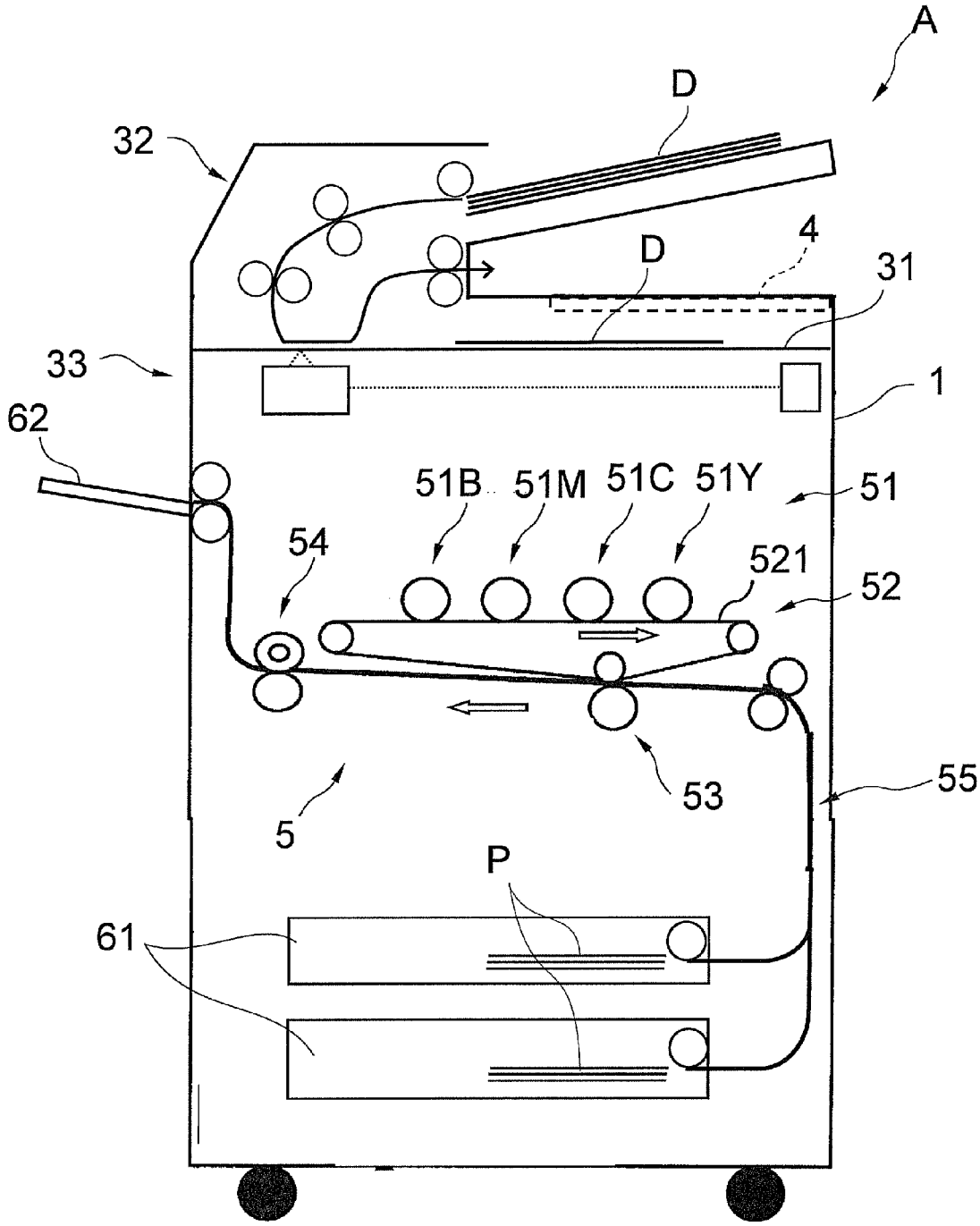
FIG. 1 is a schematic diagram of an image forming apparatus of a first embodiment.

As illustrated in FIG. 1, the image forming apparatus A includes a main body casing 1, a platen glass 31, a document feeding device 32, an image scanning section 33, a operating panel 4, a print section 5, paper cassettes 61, a discharge tray 62 or the like.

The platen glass 31 is disposed on the top surface of the main body casing 1.

The document feeding device 32 is disposed above the main body casing 1 while opposed to the platen glass 31. The document feeding device 32 includes a document tray, a document-discharge tray and a document feeding section. A single or plurality of sheets of documents D is put on the document tray. The document-discharge tray receives the documents D after images on the documents D are scanned. The document feeding section is configured to pull the documents D on the document tray one by one and transport them to the document-discharge tray one by one. The document feeding section includes a plurality of rollers and a driving unit to rotate the rollers. The document feeding device 32 also functions as a document cover for pressing a sheet of document put on the platen glass 31.

The image scanning section 33 is disposed in the interior of the main body casing 1. Specifically, the image scanning section 33 is disposed in an upper section below the platen glass 31.

Although not illustrated in the figure, the image scanning section 33 includes a light source, a mirror for guiding light from the light source to a sheet of document D put on the platen glass 31, a photoelectric conversion element (e.g., charge coupled device (CCD) image sensor), a mirror and a ens arranged to guide the reflected light from the sheet of document D to a scanning element, and a data processing section to generate print data by conducting a variety of processing (e.g., filter processing) with respect to an electric signal outputted from the photoelectric conversion element.

The term "print data" may be herein referred to as "image data for printing".

Furthermore, the image scanning section 33 includes a carriage and a moving section. The carriage is configured to carry the light source and the mirror in the image scanning section 33. The moving section is configured to move the carriage in a sub-scanning direction (i.e., horizontal direction in FIG. 1). When the moving section moves the carriage, the image scanning section 33 is capable of scanning an image of entirety of a sheet of document D put on the platen glass 31. Additionally, the image scanning section 33 is capable of scanning an image of a sheet of document D while the document D is being transported in the document feeding device 32. Note a main-scanning direction is perpendicular to the drawing illustrated in FIG. 1.

The operating panel 4 is configured to receive a user's instruction under the control of a control device 8. Specifically, contents of the user's instruction mainly include a selection of the size of printing paper P, start or stop of printing (i.e., image formation), the number of printing, a selection of printing type (i.e., color printing or monochrome printing).

The operating panel 4 is disposed on the top of the main body casing 1. The operating panel 4 includes a display device, a touch sensor and a variety of hard keys. The display device is configured to display an operational condition of the image forming apparatus A. For example, a liquid-crystal display (LCD) panel is used as the display device. The touch sensor forms a touch panel together with the display device. The hard keys include a start key, a cancel key and the like.

The print section 5 includes four image forming units 51B, 51M, 51C and 51Y, a primary transfer part 52, a secondary transfer part 53, a fixation part 54 and a paper transportation part 54.

Each of the image forming units 51B, 51M, 51C and 51Y is configured to form a toner image by developing print data. The primary transfer part 52 is configured to primarily transfer the toner image to a belt 521. The secondary transfer part 53 is configured to secondarily transfer the toner image, formed on the belt 521, onto a sheet of printing paper P. The fixation part 54 is configured to fix the toner image onto the sheet of printing paper P by the application of heat and pressure. The paper transportation part 55 is configured to transport a sheet of printing paper P from any one of the paper cassettes 61 to the discharge tray 62 via the secondary transfer part 53 and the fixation part 54.

As illustrated in FIG. 1, more specifically, the image forming units 51B, 51M, 51C and 51Y are disposed along a circulation direction of the belt 521 of the primary transfer part 52 (i.e., a clockwise direction in FIG. 1). In short, the image forming apparatus A is a tandem device.

In printing a color image, the image forming units 51B, 51M, 51C and 51Y form corresponding black, magenta, cyan and yellow images. When the belt 521 circulates, the black, magenta, cyan and yellow images are transferred onto the belt 521 while overlapping in this color order. Thus a full-color image is formed. Subsequently, the fill-color image is secondary transferred onto a sheet of printing paper P as described above.

In printing a monochrome image, on the other hand, only the image forming unit 51B is configured to conduct image formation. Similarly to the printing of a color image, the formed black image is primarily transferred onto the belt 521 and the transferred black image is secondarily transferred onto a sheet of printing paper P. In this way, a color image or a monochrome image is printed on the sheet of printing paper P.

For distinguishing the image forming unit 51B and the image forming units 51M, 51C and 51Y, the image forming unit 51B may be hereinafter referred to as "a monochrome image forming unit" whereas the image forming units 51M, 51C and 51Y may be hereinafter referred to as "color image forming units".

Additionally, an image forming section 51, illustrated in FIG. 1, includes all the image forming units 51B, 51M, 51C and 51Y.

1-2. Image Forming Unit

Figure 2:
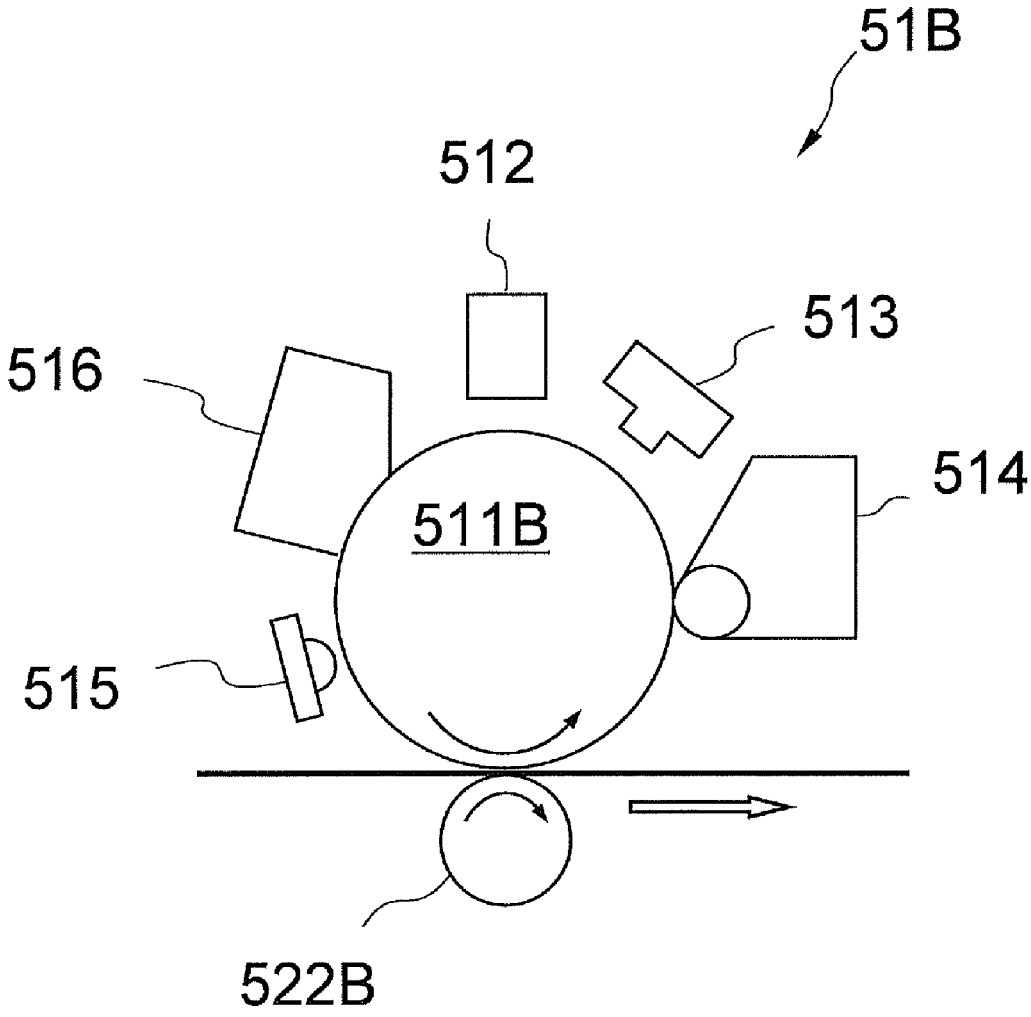
FIG. 2 is a diagram of an image forming unit of the image forming apparatus.

As illustrated in FIG. 2, the image forming unit 51B includes a photosensitive drum 51B, an electrostatic charging part 512, a drawing part 513, a developing part 514, a neutralizing part 515 and a drum cleaning part 516. The photosensitive drum 511B is an example of a photosensitive body. The photosensitive drum 511B is allowed to rotate in the counter-clockwise direction in FIG. 2. The members 512 to 516 are disposed along the direction of rotation of electrostatic drum 511B. The electrostatic charging part 512 is configured to uniformly charge the photosensitive drum 511B. The drawing part 513 is configured to draw an electrostatic latent image based on the print data by irradiating a laser light on the charged photosensitive drum 511B. The developing part 514 is configured to develop an electrostatic latent image by supplying black toner to the surface of the photosensitive drum 511B. The neutralizing part 515 is configured to neutralize the photosensitive drum 511B after the primary transference. The drum cleaning part 516 is configured to remove toner remaining on the photosensitive drum 511B after the neutralization. Note the image forming unit 51B includes a driving part (not illustrated in the figure) to rotate the photosensitive drum 511B in the counter-clockwise direction.

Configurations of the image forming units 51B, 51M, 51C and 51Y are basically the same excluding the point that toner colors used therein (i.e., black, magenta, cyan and yellow) are different from each other. Accordingly, detailed illustration of the image forming units 51M, 51C and 51Y will be omitted in the figures. Furthermore, reference numerals "511M", "511C" and "511Y" will be hereinafter given to photosensitive drums of the image forming units 51M, 51C and 51Y, respectively.

1-3. Primary Transfer Part 52

Figure 3:
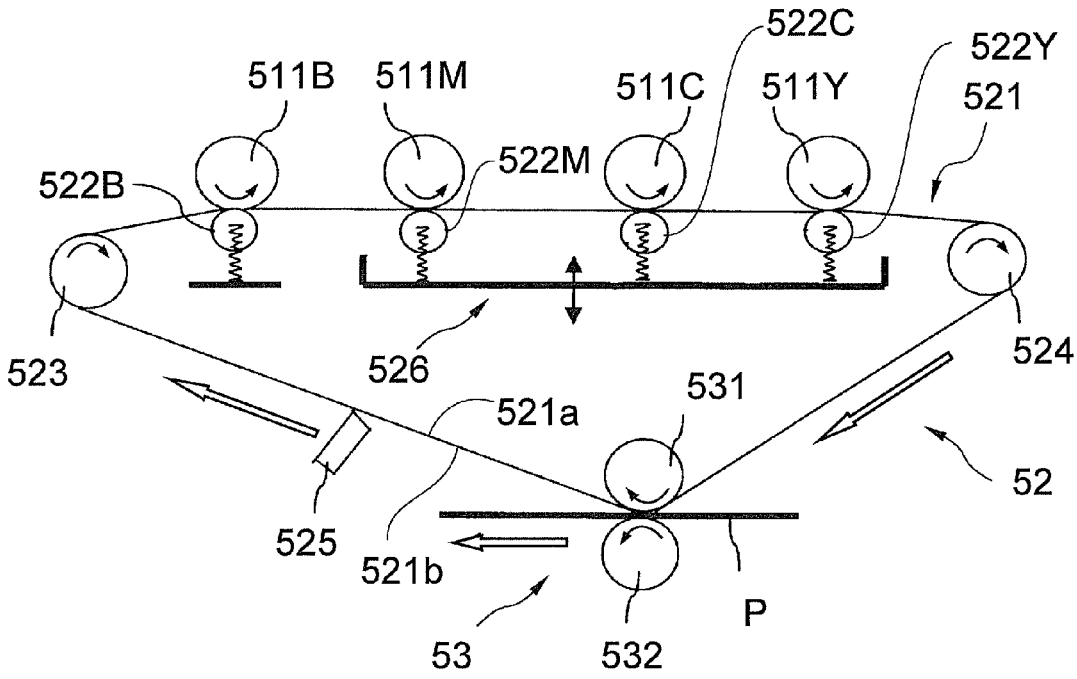
FIG. 3 is a diagram for illustrating a press-contact action in the image forming apparatus.

As illustrated in FIG. 3, the primary transfer part 52 includes the belt 521, driven rollers 522B, 522M, 522C and 522Y, a driving roller 523, a tension roller 524, a cleaner 525 and a displacement operation section 526. Additionally, the primary transfer part 52 further includes a driving part (not illustrated in the figure) to rotate the driving roller 523 in the clockwise direction in FIG. 3 and the like.

As illustrated in FIG. 3, the belt 521 of the primary transfer part 52 is an endless loop belt. The inner surface of the loop belt 521 is hereinafter referred to as an inner surface 521*a* whereas the outer surface thereof is hereinafter referred to as an outer surface 521*b*.

The belt 521 is wrapped around the driving roller 523, the tension roller 524 and a secondary transfer roller 531. The belt 521 circulates in the clockwise direction in conjunction with clockwise rotation of the driving roller 523. In accordance with the circulation, the driven rollers 522B, 522M, 522C and 522Y, the tension roller 524 and the secondary transfer roller 531 rotate in the clockwise direction.

As illustrated in FIGS. 1 to 3, the belt 521 is disposed below the image forming units 51B, 51M, 51C and 51Y. Specifically, a part of the outer surface 521*b* of the belt 521, positioned between the driving roller 523 and the tension roller 524, is opposed to the photosensitive drums 511B, 511M, 511C and 511Y.

The tension roller 524, the secondary transfer roller 531 to be described and the driving roller 523 are disposed in the inner side of the loop belt 521. They are positioned along the circulation direction of the belt 521 in the order of the tension roller 524, the secondary transfer roller 531 and the driving roller 523.

The driven rollers 522B, 522M, 522C and 522Y are disposed in the inner side of the loop belt 521. They are positioned between the driving roller 523 and the tension roller 524 along the travel direction of the belt 521 (i.e., direction from the driving roller 523 to the tension roller 524) in the order of the driven rollers 522B, 522M, 522C and 522Y. The driven rollers 522B, 522M, 522C and 522Y are respectively opposed to the photosensitive drum 511B, 511M, 511C and 511Y through the belt 521. Additionally, the driven rollers 522B, 522M, 522C and 522Y are arranged to rotate in conjunction with the circulation of the belt 521 when they elastically make contact with the belt 521.

The driven roller 522B makes contact with the inner surface 521*a* of the belt 521 for making the outer surface 521*b* of the belt 521 come in contact with the photosensitive drum 511B.

The driven rollers 522M, 522C and 522Y are moved between a contact position and a separate position by means of the displacement operation section 526.

In the contact position, the photosensitive drums 511M, 511C and 511Y make contact with the outer surface 521*b* of the belt 521 in conjunction with press-contact of the driven rollers 522M, 522C and 522Y with the inner surface 521*a* of the belt 521. In the separate position, on the other hand, the photosensitive drums 511M, 511C and 511Y are separated from the outer surface 521*b* of the belt 521 in conjunction with separation of the driven roller rollers 522M, 522C and 522 Y away from the inner surface 521*a f* the belt 521.

The tension roller 524 is disposed for applying predetermined tension to the belt 521 in the direction from the inner surface 521*a* to the outer surface 521*b*. The disposition of the tension roller 524 retains the belt 521 without loosening.

As illustrated in FIG. 3, the cleaner 525 is disposed between the secondary transfer roller 531 and the driving roller 523. The cleaner 525 makes contact with the outer surface 521*b* of the belt 521. Accordingly, the cleaner 525 is capable of removing toner remaining on the outer surface 521*b* of the belt 521 after the secondary transference.

As described above, the driving part drives the driving roller 523, and the driving roller 523 accordingly rotates in the clockwise direction. The belt 521 circulates in the clockwise direction in conjunction with the clockwise rotation of the driving roller 523.

The displacement operation section 526 is configured to set the driven rollers 522M, 522C and 522Y to be in the contact position or the remote position by moving the rollers upward or downward.

Specifically, the displacement operation section 526 includes a support member and a movable part. The support member is a plate member for supporting the driven rollers 522M, 522C and 522Y. The movable part (e.g., a solenoid) is configured to fix the support member to the main body casing 1 for allowing the support member to move upward and downward (i.e., for allowing the support member to move toward/away from the inner surface 521*a* of the belt 521).

Furthermore, coil springs are fixed to the support member, and bearings are attached to the coil springs. The driven rollers 522M, 522C and 522Y are rotatably retained by the bearings.

The solenoid of the displacement operation section 526 is activated under the control of a displacement control section 83 to be described. The support member moves upward or downward in conjunction with the activation of the solenoid.

When the support member of the displacement operation section 526 moves toward the belt 521, the driven rollers 522M, 522C and 522Y pushes the belt 521 upward. Accordingly, the displacement operation section 526 is capable of making the belt 521 come in contact with the photosensitive drums 511M, 511C and 511Y. Positions of the driven rollers 522M, 522C and 522Y at this time are the aforementioned contact positions (see FIG. 3). Note a condition of the displacement operation section 526 at this time is hereinafter referred to as a press-contact condition.

When the image forming units 51B, 51M, 51C and 51Y form images in the press-contact condition of FIG. 3, four-color images are formed on the belt 521 while overlapping with each other as described above.

Figure 4:
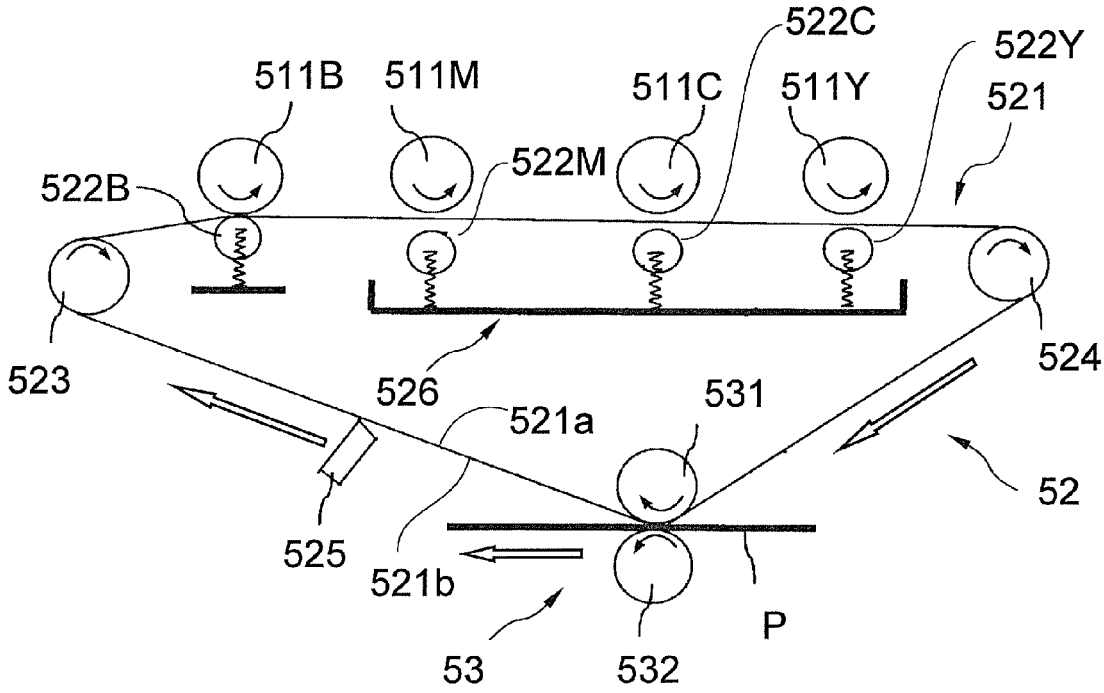
FIG. 4 is a diagram for illustrating a release action in the image forming apparatus.

Furthermore, when the support member of the displacement operation section 526 moves away from the belt 521, the driven rollers 522M, 522C and 522Y accordingly move away from the belt 521. Accordingly, the displacement operation section 526 is capable of moving the belt 521 away from the photosensitive drums 511M, 511C and 511Y. Positions of the driven rollers 522M, 522C and 522Y at this time correspond to the remote positions (FIG. 4). A condition of the displacement operation section 526 at this time is hereinafter referred to as a release condition.

In the release condition of FIG. 4, the belt 521 is retained by the driving roller 523, the driven roller 522B, the tension roller 524 and the secondary transfer roller 531. Accordingly, the belt 521 is prevented from loosening. As illustrated in FIG. 4, the belt 521 is especially retained by the driven roller 522B for making contact with the photosensitive drum 511B.

In the release condition of FIG. 4, only a monochrome image, formed by the image forming unit 51B, is transferred onto the belt 521.

1-4. Secondary Transfer Part 53

As illustrated in FIG. 3, the secondary transfer part 53 includes the secondary transfer roller 531 and a press-contact roller 532.

The secondary transfer roller 531 is opposed to the press-contact roller 532 through the belt 521. The secondary transfer roller 531 makes contact with the inner surface 521*a* of the belt 521 whereas the press-contact roller 532 makes contact with the outer surface 521*b* of the belt 521.

In printing, the belt 521 circulates and the aforementioned paper transportation part 55 transports a sheet of printing paper P into a space between the press-contact roller 532 and the belt 521. Accordingly, the toner image, formed on the belt 521, is secondarily transferred onto the sheet of printing paper P while the sheet of printing paper P passes through the space between the belt 521 and the press-contact roller 532.

1-5. Control Related Structure

Figure 5:
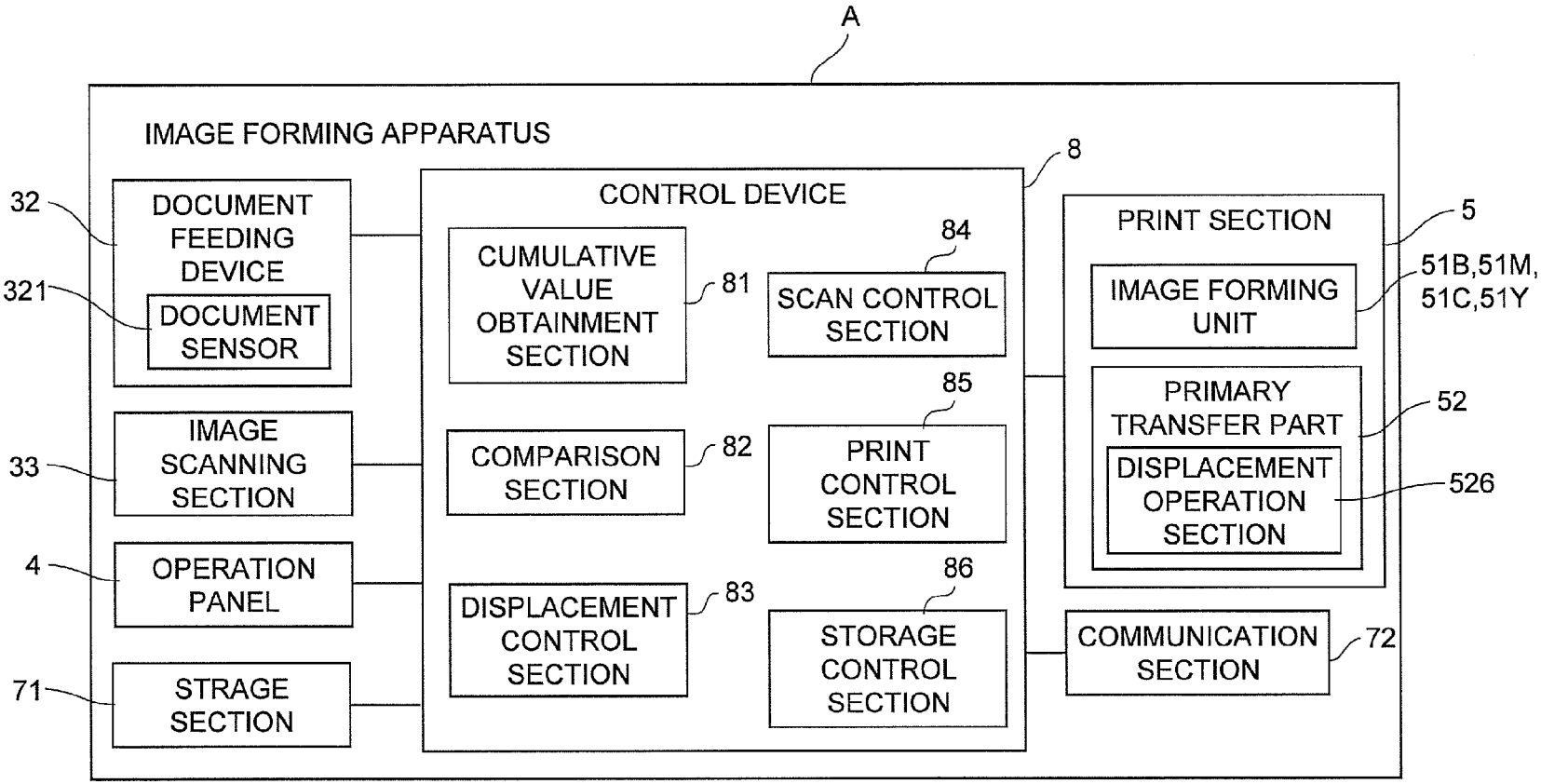
FIG. 5 is a block diagram for illustrating general structure of the image forming apparatus.

As illustrated in FIG. 5, the image forming apparatus A further includes a storage section 71, a communication section 72 and the control device 8, in addition to the aforementioned elements. Note FIG. 5 illustrates only a part of the elements forming the image forming apparatus A for easy understanding.

For example, the storage section 71 is a computer-readable and writable hard disc drive (HDD) for storing a variety of information. The information mainly includes print data to be transmitted from the image scanning section 33 and the communication section 72, the cumulative number of color printing and the cumulative number of monochrome printing, an operation program of the control device 8.

The communication section 72 is an interface for transmitting/receiving a variety of data (e.g., the print data) to/from external apparatuses/peripherals (e.g., other multifunctional peripherals (MFPs) or personal computers) through a network by means of a predetermined protocol under the control of the control device 8.

The control device 8 is configured to control operations of the document feeding device 32, the image scanning section 33, the operating panel 4, the print section 5, the storage section 71 and the communication section 72. Specifically, the control device 8 includes a cumulative value obtainment section 81, a comparison section 82, the displacement control section 83, a scanning control section 84, a print control section (image formation control section) 85, a storage control section 86 and the like. The control device 8 includes a CPU (not illustrated in the figure), a memory preliminarily storing a program for booting the CPU (not illustrated in the figure), an input-output interface (not illustrated in the figure) and the like. The functional sections 81 to 86 of the control device 8 are realized when the CPU operates based on the operational program stored in the storage section 71.

The cumulative value obtainment section 81 is configured to separately calculate the cumulative number of color printing and the cumulative number of monochrome printing regarding the number of images printed by the print section 5. The calculation is conducted every time each image is printed. Calculation result is stored in the storage section 71. Note the cumulative number of color printing is also referred to as "the cumulative number of color images" whereas the cumulative number of monochrome printing is also referred to as "the cumulative number of monochrome images".

In the present embodiment, the term "the number of (color/monochrome) images" means the number of printed material produced as a result of print processing. In performing 2-in-1 aggregate print processing, for instance, two-page image data will be printed out as a single sheet of printed material. Therefore, the cumulative value obtainment section 81 adds "1" to the cumulative number.

The comparison section 82 is configured to refer to the calculation result by the cumulative value obtainment section 81, compare the cumulative number of color printing and the cumulative number of monochrome printing, and transmit a comparison result to the displacement control section 83.

The displacement control section 83 is configured to control an operation of the displacement operation section 526 in accordance with the comparison result.

Detailed explanation of displacement control will be described below with reference to a flowchart.

The scanning control section 84 is configured to cause the image scanning section 33 to obtain print data from a sheet of document. Additionally, the scanning control section 84 is configured to cause the document feeding device 32 to feed a sheet of document if necessary.

The print control section 85 is configured to obtain the print data from the storage section 71 and cause the print section 5 to execute printing based on the print data.

When the print data relates to color printing, the print control section 85 is configured to appropriately cause the image forming units 51B, 51M, 51C and 51Y to form images in accordance with the content of color printing. When the print data relates to monochrome printing, on the other hand, the print control section 85 is configured to cause only the image forming unit 51B to form an image.

Additionally, the print control section 85 is configured to cause the primary transfer part 52, the secondary transfer part 53, the paper transportation device 55 and the like to operate for producing printed material. A variety of conditions (e.g., the size of printing paper to be used) are set in accordance with contents of instructions received through the operating panel 4 and the communication section 72.

The storage control section 86 is configured to store the print data, obtained by the image scanning section 33 or the communication section 72, in the storage section 71.

The storage control section 86 is configured to store the print data in the storage section 71 on a job-to-job basis in accordance with the instruction received through the operating panel 4 or the communication section 72. The print data may include data of plural-page printing.

Note the term "print job" may be referred to as "an image formation job". The print job includes photocopy, printout, facsimile printing and the like.

Furthermore, as illustrated in FIG. 5, the document feeding device 32 includes a document sensor 321. The document sensor 321 is configured to output different signals to the control device 8 depending on whether or not a sheet of document D is set in the document feeding device 32. The document sensor 321 may be any suitable devices, such as a variety of sensors (e.g., an optic sensor and a contact sensor) and a device for detecting torque of a transportation roller of the document feeding device 32.

1-6. Displacement Control

Next, displacement control will be hereinafter explained.

Figure 6:
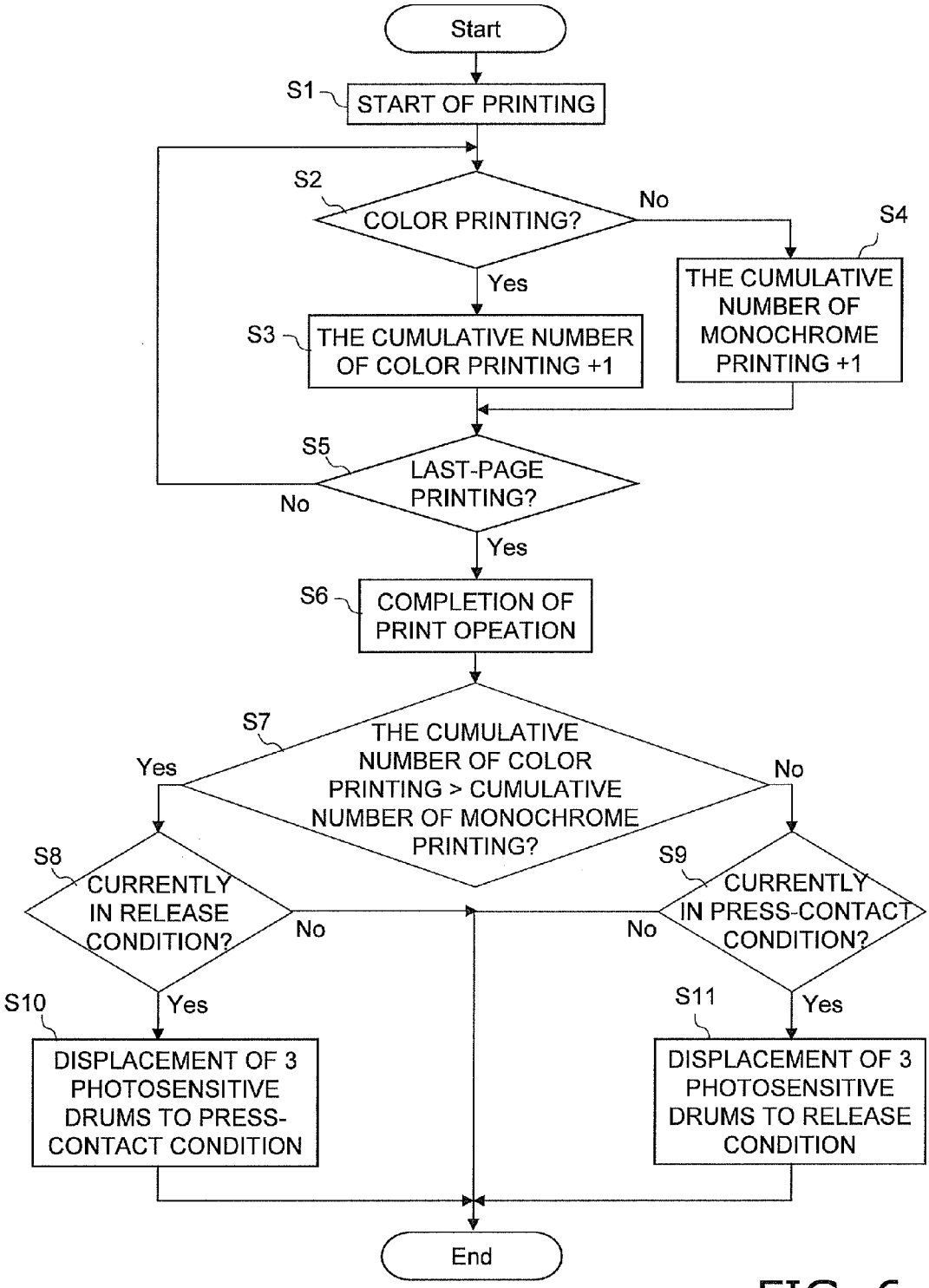
FIG. 6 is a flowchart for illustrating position control of a belt section in the image forming apparatus.

As illustrated in FIG. 6, in executing a print job, printing is started under the control of the print control section 85 based on the content of an instruction received through the operating panel 4 or the communication section 72 (Step S1).

When one-page printing is completed in the print job and the one-page printing is color printing (Yes, in Step S2), the cumulative value obtainment section 81 adds "1" to the cumulative number of color printing. On the other hand, when the one-page printing is monochrome printing (No, in Step S2), the cumulative value obtainment section 81 adds "1" to the cumulative number of monochrome printing.

Next, when the printed page is not the last page in the print job, in other words, when there still left a page to be printed in the current print job (No, in Step S5), printing of the next page is executed. Steps S2 to S5 will be repeated until the printed page corresponds to the last page in the current print job.

When printing of the last page is executed (Yes, in Step S5), the print control section 85 stops the printing operation (Step S6). In other words, the print job is completed.

Next, the comparison section 82 compares the cumulative number of color printing and the cumulative number of monochrome printing. When the cumulative number of color printing is greater than the cumulative number of monochrome printing (Yes, in Step S7), Step S8 will be executed. On the other hand, when the cumulative number of color printing is less than the cumulative number of monochrome printing (No, in Step S7), Step S9 will be executed.

In Step 8, the displacement control section 83 determines if the displacement operation part 25 is in the release condition. When the displacement control section 83 determines that the displacement operation part 25 is in the release condition (Yes, in Step S8), Step S10 will be executed. In Step S10, the displacement control section 83 causes the displacement operation part 25 to change the release condition into the press-contact condition. On the other hand, when the displacement control section 83 determines that the displacement operation part 25 is not in the release condition (No in Step S8), the processing will be completed while the displacement operation part 25 keeps the press-contact condition.

In Step 9, the displacement control section 83 determines if the displacement operation part 25 is in the press-contact condition. When the displacement control section 83 determines that the displacement operation part 25 is in the press-contact condition (Yes, in Step S9), Step S11 will be executed. In Step S11, the displacement control section 83 causes the displacement operation part 25 to change the press-contact condition into the release condition. On the other hand, when the displacement control section 83 determines that the displacement operation part 25 is not in the press-contact condition (No, in Step S9), the processing will be completed while the displacement operation part 25 keeps the release condition.

Thus, the image forming apparatus A stands-by until the next print job is received either in a condition that the belt 521 and all the photosensitive drums 511B, 511M, 511C and 511Y preliminarily make contact with each other or in a condition that the belt 521 and the photosensitive drums 511M, 511C and 511Y are preliminarily separated apart, in accordance with the comparison result of cumulative number of monochrome printing with the cumulative number of color printing.

Note when the cumulative number of printing is not stored in the storage section 71, that is, when first print processing is executed after installation of the image forming apparatus A, the displacement control section 83 is configured to control the displacement operation section 526 based on the content of an instruction received through the operating panel 4 or the communication section 72.

In this case, when the received print job relates to color printing, the displacement control section 83 causes the displacement action section 526 to set the driven rollers 522M, 522C and 522Y to be in the contact positions (see FIG. 3). When the print control section 85 causes the print section 5 to execute color printing in the press-contact condition of FIG. 3, full-color printed material will be produced.

On the other hand, when the received print job relates to monochrome printing, the displacement control section 83 causes the displacement operation section 526 to set the driven rollers 522M, 522C and 522Y to be in the separate positions (see FIG. 4). When the print control section 85 causes the print section 5 to execute monochrome printing in the release condition of FIG. 4, monochrome printed material will be produced.

As described above, when a print job (i.e., a series of printing operations) is completed, the image forming apparatus A compares the cumulative number of color printing counted so far and the cumulative number of monochrome printing counted so far. When the cumulative number of color printing is greater than the cumulative number of monochrome printing, the image forming apparatus A stands-by for the next print job in a condition that the belt 521 and the photosensitive drums 511M, 511C and 511Y preliminarily make contact with each other. When the cumulative number if monochrome printing is greater than the cumulative number of color printing, on the other hand, the image forming apparatus A stands-by for the next print job in a condition that the belt 521 and the photosensitive drums 511M, 511C and 511Y are preliminarily separated apart.

In general, the image forming apparatuses have tendencies for the usage of color printing and monochrome printing. Therefore, the image forming apparatus A, configured to operate as described above, is capable of reducing chances for executing a displacement operation when the next print job is started.

Consequently, the image forming apparatus A is capable of promptly starting the first-page printing in each print job. Furthermore, the image forming apparatus A is capable of prolonging the life cycle of the photosensitive drums 511M, 511C and 511Y exclusively used for color printing.

OTHER EXAMPLE EMBODIMENTS

The image forming apparatus A of the first embodiment is configured to monitor the color print data and the monochrome print data to be inputted into the image forming units 51B, 51M, 51C and 51Y and obtain the cumulative number of color printing (the cumulative number of color images) and the cumulative number of monochrome printing (the cumulative number of monochrome images) by incrementing the number of color printing and the number of monochrome printing by one every time print processing (image formation processing) is completed. However, the image forming apparatus is not limited to the configuration.

For example, the cumulative value obtainment section 81 may be configured to obtain the cumulative number of color printing and the cumulative number of monochrome printing based on the number of printing (i.e., the number of image formation) of color images and the number of printing of monochrome images, inputted and instructed through the operating panel 4 or the communication section 72.

The cumulative value obtainment section 81 may be configured to obtain the cumulative number of color/monochrome images regarding all the past images. Alternatively, the cumulative value obtainment section 81 may be configured to obtain the cumulative number of color/monochrome images regarding some of all the past images, especially regarding the predetermined number of images most-recently printed. In this case, "the predetermined number" may be a variable or a constant.

First, an explanation will be done for the case that the predetermined number is a variable. As illustrated in Table 1, for instance, the cumulative value obtainment section 81 is configured to count all the images as targets for sum of the cumulative number of the color printing and the cumulative number of monochrome printing (hereinafter referred as "the total cumulative number of printing") until the total cumulative number reaches 1000. In other words, when the total cumulative number is 999, the cumulative value obtainment section 81 is configured to obtain the cumulative number of color printing and the cumulative number of monochrome printing regarding all the $1^{st}$-$999^{th}$ images.

When the total cumulative number reaches 1000, the cumulative value obtainment section 81 is configured to obtain the cumulative number of color printing and the cumulative number of monochrome printing regarding $901^{st}$-$1000^{th}$ images (i.e., 100 images). In other words, the number of color images, included in the 100 images, is used as the cumulative number of color printing whereas the number of monochrome images, included in the 100 images, is used as the cumulative number of monochrome printing. In the example of Table 1, when the total cumulative number reaches 1000, 39 images out of $901^{st}$-$1000^{th}$ images are color images whereas 61 images out of $901^{st}$-$1000^{th}$ images are monochrome images. The $1^{st}$-$900^{th}$ images are precluded from the targets for the total cumulative number of printing.

Subsequently, the cumulative value obtainment section 81 is configured to obtain the cumulative number of color printing and the cumulative number of monochrome printing by accumulating the number of color printing and the number of monochrome printing regarding $901^{st}$ and subsequent images until the total cumulative number reaches 2000.

In other words, when the total cumulative number reaches 1001, the cumulative number of color/monochrome printing is obtained from $901^{st}$-$1001^{st}$ images (i.e., 101 images). Additionally, when the total cumulative number reaches 1050, the cumulative number of color/monochrome printing is obtained from $901^{st}$-$1050^{th}$ images (i.e., 150 images).

As illustrated in Table 1, when printing is further executed and the total cumulative number reaches 2000, the cumulative value obtainment section 81 is configured to obtain the cumulative number of color printing and the cumulative number of monochrome printing regarding $1901^{st}$-$2000^{th}$ images (i.e., 100 images). Subsequently, the cumulative value obtainment section 81 continues processing of cumulatively counting images until the total cumulative number reaches 3000.

In other words, in the example of Table 1, the cumulative value obtainment section 81 is configured to reset the cumulative value every time the total cumulative number reaches one unit. In this case, "one unit" is defined as 1000. In the reset of the total cumulative value, the most-recent 100 images are selectively taken out of the 1000 target images for the total cumulative number of printing, whereas the rest of the 1000 target images (i.e., the other old 900 images) are precluded.

TABLE 1

| Total Cumulative Number | Cumulative Target Range (sequence) | Cumulative Number of Color Printing | Cumulative Number of Monochrome Printing |
|---|---|---|---|
| 1 | 1 | 1 | 0 |
| 2 | 1~2 | 1 | 1 |
| ... | ... | ... | ... |
| 999 | 1~999 | 400 | 599 |
| 1000 | 901~1000 | 39 | 61 |
| 1001 | 901~1001 | 40 | 61 |
| ... | ... | ... | ... |
| 1999 | 901~1999 | 550 | 449 |
| 2000 | 1901~2000 | 55 | 45 |

With the aforementioned configuration, it is possible to prevent the cumulative number of printing from being enlarged too much. Accordingly, it is possible to simplify processing of calculating the cumulative number of printing. In other words, a speedier calculation processing will be achieved.

In the aforementioned configuration, one unit is not limited to 1000. Additionally, in the reset of total cumulative number, the number of images to be left is not limited to 100. These numbers may be arbitrarily changed. However, it is desirable to set them to fall in a range for accurately detecting tendency of the number of color printing and the number of monochrome printing.

When the sum of the cumulative number of color printing and the cumulative number of monochrome printing (i.e., the total cumulative number) once reaches a predetermined number, the cumulative value obtainment section 81 may be configured to continuously set the total cumulative number to the predetermined number.

In an example of Table 2, "the predetermined number" is set to be 1000. Therefore, the cumulative value obtainment section 81 is configured to count all the images as targets for the total cumulative number of printing until the total accumulative number reaches 1000 since the start of print processing. In other words, when the total cumulative number is 1000, color images, included in all the $1^{st}$-$1000^{th}$ images, are counted as the cumulative number of color printing whereas monochrome images, included in all the $1^{st}$-$1000^{th}$ images, are counted as the cumulative number of monochrome printing.

When the total cumulative number reaches 1001, the cumulative value obtainment section 81 is configured to obtain the cumulative number of color printing and the cumulative number of monochrome printing regarding the $2^{nd}$-$1001^{st}$ images of all the images. Furthermore, when the total cumulative number reaches "1002", the cumulative value obtainment section 81 is configured to obtain the cumulative number of color printing and the cumulative number of monochrome printing regarding the $3^{rd}$-$1002^{nd}$ images of all the images.

Thus, in the example of table 2, the cumulative number of color printing and the cumulative number of monochrome printing are always obtained regarding the most recent 1000 images.

TABLE 2

| Total Cumulative Number | Cumulative Target Range (sequence) | Cumulative Number of Color Printing | Cumulative Number of Monochrome Printing |
|---|---|---|---|
| 1 | 1 | 1 | 0 |
| 2 | 1~2 | 1 | 1 |
| ... | ... | ... | ... |
| 999 | 1~999 | 400 | 599 |
| 1000 | 1~1000 | 401 | 599 |
| 1001 | 2~1001 | 402 | 598 |
| ... | ... | ... | ... |
| 1999 | 1000~1999 | 550 | 450 |
| 2000 | 1001~2000 | 549 | 451 |

Figure 8:
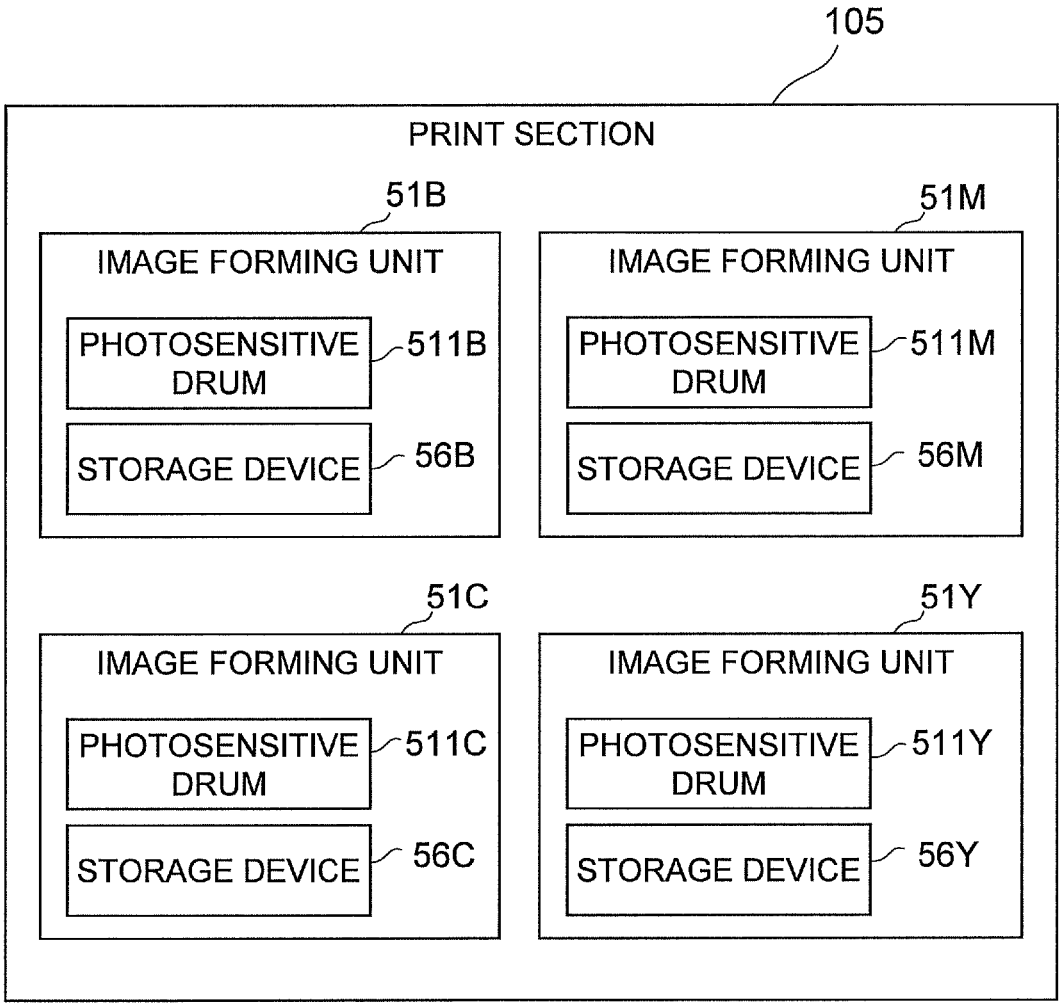
FIG. 8 is a block diagram for illustrating a part of an image forming apparatus of yet another embodiment.

As illustrated in FIG. 8, the image forming apparatus A may be provided with a print section 105 instead of the print section 5. The print section 105 includes storage devices 56B, 56M, 56C and 56Y. The storage devices 56B, 56M, 56C and 56Y corresponds to image forming units 51B, 51M, 51C and 51Y, respectively. Magnetic memories, semiconductor memories or the like are used as the storage devices 56B, 56M, 56C and 56Y. The storage devices 56B, 56M, 56C and 56Y are configured to record the number of images to be drawn on the photosensitive drums 511B, 511M, 511C and 511Y, respectively. Specifically, the storage devices 56B, 56M, 56C and 56Y are configured to store information of the number of images in the print data to be transmitted to the image forming units 51B, 51M, 51C and 51Y, respectively. For example, when two sets of monochrome images are printed under the condition that a set of monochrome images is composed of 10 monochrome images, "20" is added to the number of monochrome images stored in the storage device 56B. On the other hand, when two sets of color images is printed under the condition that a set of color images is composed of 10 color images, "20" is added to the number of color images stored in all the storage devices 56B, 56M, 56C and 56Y.

In other words, the storage content of the storage device 56B of the black image forming unit 51B corresponds to the total printing number (i.e., sum of the cumulative number of monochrome printing and the cumulative number of color printing). The storage contents of the other storage devices 56M, 56C and 56Y correspond to the cumulative number of color printing.

The cumulative value obtainment section 81 is configured to obtain the cumulative number of monochrome printing by subtracting the cumulative number of color printing from the total printing number. The comparison section 82 is configured to execute the processing of Step S7 in FIG. 6 by comparing thus obtained cumulative number of monochrome printing and thus obtained cumulative number of color printing.

The storage device 56B functions as first and second storage devices. The storage devices 56M, 56C and 56Y function as first storage devices. The first storage device stores information of the number of images included in color image data. The second storage device stores information of the number of images included in monochrome image data.

The second storage device is may be separate from the first storage device, unlike this embodiment.

Figure 9:
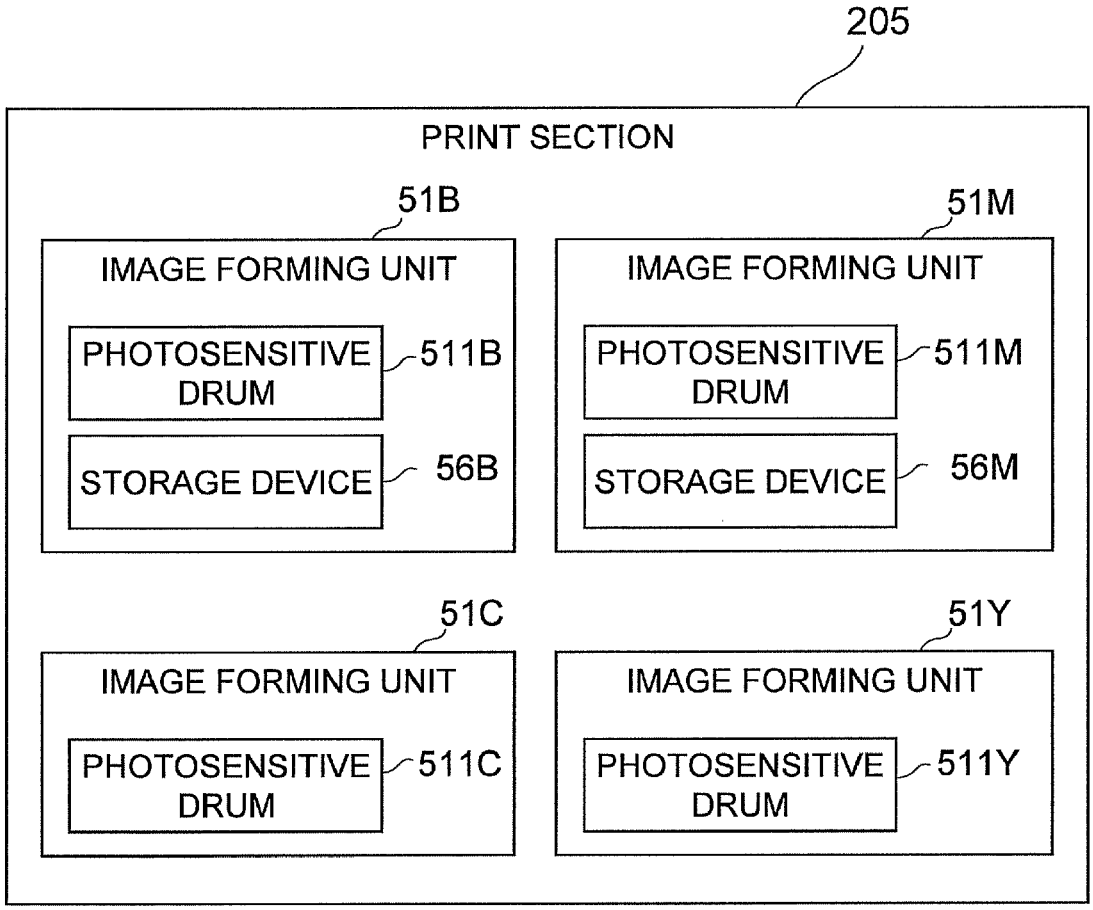
FIG. 9 is a block diagram for illustrating a part of an image forming apparatus of yet another embodiment.

In the configuration discussed above, it is possible to arbitrarily omit any two of the storage devices 56M, 56C and 56Y. For example, as illustrated in FIG. 9, the image forming apparatus A may be provided with a print section 205 instead of the print section 105 illustrated in FIG. 8. The print section 205 is provided with storage devices 56B and 56M. The storage device 56B corresponds to the black image forming unit 51B whereas the storage device 56M corresponds to the magenta image forming unit 51M. In this case, the print section 205 is not provided with the storage unit 56C the storage unit 56Y, corresponding to the cyan image forming unit 51C and the yellow image forming unit 51Y, respectively. Additionally, the storage content of the storage device 56M herein corresponds to the cumulative number of color printing.

The cumulative value obtainment section 81 is configured to obtain the cumulative number of monochrome printing by subtracting the cumulative number of color printing stored in the storage device 56M of the magenta image forming unit 51M from the total printing number stored in the storage device 56B of the black image forming unit 51B. The comparison section 82 is configured to execute the aforementioned processing of Step 7 in FIG. 6 by comparing thus obtained cumulative number of monochrome printing and thus obtained cumulative number of color printing.

It is possible to calculate the cumulative number of color printing and the cumulative number of monochrome printing based on a period of time when the photosensitive drums 511B, 511M, 511C and 511Y operate in a variety of operations (e.g., a warm-up operation and a color regulation operation) excluding a color print operation and a monochrome print operation.

Figure 7:
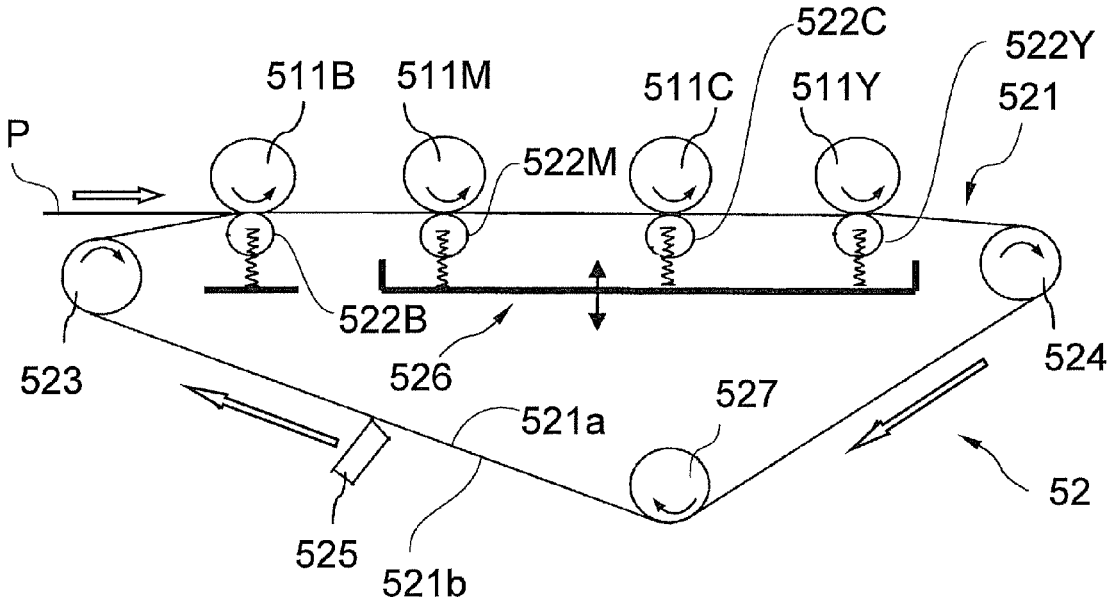
FIG. 7 is a diagram for illustrating a part of an image forming apparatus of another embodiment.

In the image forming apparatus A of the aforementioned embodiment, the belt 521 functions as a primary transfer belt. As illustrated in FIG. 7, however, the belt 521 may function as a belt for transporting a sheet of printing paper P. In the embodiment of FIG. 7, a paper transportation section (not illustrated in the figure) is configured to transport a sheet of printing paper P to the belt 521, and the belt 521 is configured to transport the sheet of printing paper P in a space between the belt 521 and the photosensitive drums 511B, 511M, 511C and 511Y. Accordingly, images are directly transferred from the photosensitive drums 511B, 511M, 511C and 511Y to the sheet of printing paper P. Especially, in the embodiment of FIG. 7, a sheet of printing paper P is transported from the vicinity of the driving roller 523 onto the belt 521.

As illustrated in the embodiment of FIG. 7, the secondary transference roller 531 is replaced by a driven roller 527 for supporting the belt 521.

Any suitable element, excluding the displacement operation section 526 and the driven rollers 522M, 522C and 522Y, may be configured to switch the belt 521 and the photosensitive drums 511M, 511C and 511Y between the contact condition and the release condition.

For example, another displacement operation part may be provided for moving the photosensitive drums 511M, 511C and 511Y with respect to the belt 521. In other words, another element is desirably used for relatively change a space between the belt 521 and the photosensitive drums 511M, 511C and 511Y.

When a predetermined print job (i.e., first job) is completed and the next job (i.e., second job) is subsequently executed, it is desirable to complete a displacement operation at an earliest-possible stage.

Additionally, it is desirable to promptly execute determinations of Steps S7-S9 in FIG. 6 when the number of printing in the first job is obtained. It is also desirable to execute processing of Steps S10-S11 immediately after the primary transference of the image of the last page of a series of pages is completed.

In other words, it is not necessary to obtain and compare the cumulative number of color printing and the cumulative number of monochrome printing after the first job is completed.

Furthermore, it is possible to execute a displacement operation before a variety of processing (e.g., secondary transference, fixation and discharge of printed material) are completed if the variety of processing are executable even after the displacement operation.

In the embodiment of FIG. 7, it is possible to execute processing of Steps S10-S11 not immediately after the first transference but immediately after transference of the image of the last page of a series of images in the first job onto a sheet of printing paper P.

According to the aforementioned embodiment, the present invention is applied to the image forming apparatus A functioning as a multifunction peripheral (MFP) having functions of a printer, a facsimile machine, a copier and a scanner. However, the present invention may be applied to a single function peripheral such as a copier, a facsimile machine and a printer.

In any of the aforementioned embodiments, the black image forming unit is configured to operate in both the monochrome image formation and the color image formation. However, two separate black image forming units may be provided. Specifically, one may be configured to operate only in the monochrome image formation whereas the other may be configured to operate only in the color image formation.

The aforementioned embodiment and the other example embodiments may be arbitrarily combined.

GENERAL INTERPRETATION

As used herein, the following directional terms "forward, rearward, above, downward, vertical, horizontal, below and transverse" as well as any other similar directional terms refer to those directions of a device equipped with the present invention. Accordingly, these terms, as utilized to describe aspects of the present invention, should be interpreted relative to a device equipped with the present invention.

The term "configured" as used herein to describe a component, section or part of a device includes hardware and/or software that is constructed and/or programmed to carry out the desired function.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applied to words having similar meanings such as the terms, "including," "having," and their derivatives. Also, the term "part," "section," "portion," "member," or "element" when used in the singular can have the dual meaning of a single part or a plurality of parts.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus, comprising;

an endless loop belt configured to rotate;

an image forming section including a color image forming unit and a monochrome image forming unit, the color image forming unit having a first image carrier and a developing section for forming a color image on the surface of the first image carrier, the monochrome image forming unit having a second image carrier and a developing section for forming a monochrome image on the surface of the second image carrier;

a displacement operation section arranged to conduct a press-contact operation and a release operation, the press-contact operation causes the first image carrier to make contact with the belt, and the release operation causes the first image carrier to separate from the belt;

a cumulative value obtainment section configured to obtain the cumulative number of color images and the cumulative number of monochrome images;

a comparison section configured to compare the cumulative number of color images and the cumulative number of monochrome images; and a displacement control section configured to control the displacement operation section to perform the press-contact operation when the cumulative number of color images is greater than the cumulative number of monochrome images after the image forming section forms a series of images, and to perform the release operation when the cumulative number of color images is less than the cumulative number of monochrome images after the image forming section forms a series of images.

2. The image forming apparatus according to claim 1, wherein the displacement control section is configured to control the displacement operation section so that the press-contact operation is executed when the cumulative number of color images is equal to the cumulative number of monochrome images.

3. The image forming apparatus according to claim 1, wherein the displacement control section is configured to control the displacement operation section so that the release operation is executed when the cumulative number of color images is equal to the cumulative number of monochrome images.

4. The image forming apparatus according to claim 1, wherein the belt is a transfer belt on which the image formed on the surface of the first image carrier and/or an image formed on the surface of the second image carrier is transferred.

5. The image forming apparatus according to claim 4, wherein the displacement control section is configured to cause the displacement operation section to operate immediately after the last image of the series of images is transferred onto the belt.

6. The image forming apparatus according to claim 4, wherein the displacement control section is configured to cause the displacement operation section to operate immediately after the last image of the series of images is transferred onto the sheet of paper.

7. The image forming apparatus according to claim 1, wherein the belt is a transportation belt for transporting a sheet of paper after the image formed on the surface of the first image carrier and/or the image formed on the surface of the second image carrier is transferred thereon.

8. The image forming apparatus according to claim 1, wherein the cumulative value obtainment section is configured to obtain the cumulative number of color images based on the number of color images externally instructed through an input and the cumulative number of monochrome images based on the cumulative number of monochrome images externally instructed through an input.

9. The image forming apparatus according to claim 1, wherein the cumulative value obtainment section is configured to obtain the cumulative number of color images based on the color image data entered into the image forming section and the cumulative number of monochrome images based on the monochrome image data entered into the image forming section.

10. The image forming apparatus according to claim 1, further comprising:

a first storage device configured to store information of the number of images included in color image data to be inputted into the image forming section; and a second storage device configured to store information of the number of images included in monochrome image data to be entered into the image forming section, wherein the comparison section is configured to compare the cumulative number of color images and the cumulative number of monochrome images based on storage contents in the first and second storage devices.

11. The image forming apparatus according to claim 1, further comprising:

an image formation control section configured to cause both the color image formation unit and the monochrome image formation unit to operate for forming a color image, the image formation control section configured to cause only the monochrome image formation unit to operate for forming a monochrome image, wherein the cumulative value obtainment section is configured to obtain the cumulative number of monochrome image by subtracting the cumulative number of color image from the total cumulative number of color images and monochrome images.

12. The image forming apparatus according to claim 1, wherein the cumulative value obtainment section is configured to obtain the cumulative number of color images and the cumulative number of monochrome images regarding most-recent predetermined number.

13. The image forming apparatus according to claim 12, wherein the cumulative value obtainment section is configured to obtain the cumulative number of color images and the cumulative number of monochrome images regarding most-recent second predetermined number of images when sum of the cumulative number of color images and the cumulative number of monochrome images reaches first predetermined number.

14. The image forming apparatus according to claim 12, wherein the cumulative value obtainment section is configured to subtract the number of images older than the most-recent second predetermined number of images from the cumulative number of color images and the cumulative number of monochrome images every time sum of the cumulative number of color images and the cumulative number of monochrome images reaches a unit number composed of the first predetermined number.

15. The image forming apparatus according to claim 1, wherein the cumulative value obtainment section is configured to obtain the cumulative number of color images and the cumulative number of monochrome images regarding the most-recent first predetermined number of images after sum of the cumulative number of color images and the cumulative number of monochrome images reaches the first predetermined number.

16. The image forming apparatus according to claim 1, wherein the second image carrier is arranged to always make contact with the belt.

* * * * *